US008088327B2

(12) United States Patent
Breden et al.

(10) Patent No.: US 8,088,327 B2
(45) Date of Patent: Jan. 3, 2012

(54) ROTARY CHARGING DEVICE FOR A SHAFT FURNACE

(75) Inventors: Emile Breden, Luxembourg (LU); Lionel Hausemer, Steinsel (LU); Emile Lonardi, Bascharage (LU); Guy Thillen, Diekirch (LU)

(73) Assignee: Paul Wurth S.A. (LU)

( * ) Notice: Subject to any disclaimer, the term of this patent is extended or adjusted under 35 U.S.C. 154(b) by 99 days.

(21) Appl. No.: 12/520,038

(22) PCT Filed: Nov. 27, 2007

(86) PCT No.: PCT/EP2007/062852

§ 371 (c)(1),
(2), (4) Date: Jun. 18, 2009

(87) PCT Pub. No.: WO2008/074596

PCT Pub. Date: Jun. 26, 2008

(65) Prior Publication Data

US 2010/0028106 A1 Feb. 4, 2010

(30) Foreign Application Priority Data

Dec. 18, 2006 (EP) ..... 06126393

(51) Int. Cl.
*C21B 7/08* (2006.01)

(52) U.S. Cl. ..... 266/199; 266/195; 266/197; 432/95; 432/96; 414/203; 414/205

(58) Field of Classification Search ..... 266/46, 266/199, 241, 184, 195, 197; 432/87, 95, 432/96; 414/203–207

See application file for complete search history.

(56) References Cited

U.S. PATENT DOCUMENTS

| | | | | |
|---|---|---|---|---|
| 3,693,812 | A | 9/1972 | Mahr et al. | |
| 3,732,487 | A * | 5/1973 | Rozelle | 323/340 |
| 3,880,302 | A | 4/1975 | Legille | |
| 4,598,325 | A * | 7/1986 | Tarzaiski | 360/39 |
| 5,252,063 | A | 10/1993 | Thillen et al. | |

(Continued)

FOREIGN PATENT DOCUMENTS

| | | |
|---|---|---|
| CS | 236408 | 6/1986 |

(Continued)

OTHER PUBLICATIONS

International Search Report PCT/EP2007/062852; Dated May 28, 2008.

*Primary Examiner* — Scott Kastler
*Assistant Examiner* — Michael Aboagye
(74) *Attorney, Agent, or Firm* — Cantor Colburn LLP

(57) ABSTRACT

A rotary charging device for a shaft furnace commonly comprises a rotary distribution configured to distribute charge material on a charging surface in the shaft furnace. A rotatable structure supports the rotary distribution means and a stationary support rotatably supports the rotatable structure. According to the invention, the charging device is equipped with an inductive coupling device including a stationary inductor fixed to the stationary support and a rotary inductor fixed to the rotatable structure. The stationary inductor and the rotary inductor are separated by a radial gap and configured as rotary transformer for achieving contact-less electric energy transfer from the stationary support to the rotatable structure by means of magnetic coupling through the radial gap for powering an electric load arranged on the rotatable structure and connected to said rotary inductor.

20 Claims, 7 Drawing Sheets

U.S. PATENT DOCUMENTS

| | | | | |
|---|---|---|---|---|
| 5,938,432 | A * | 8/1999 | Heinrich et al. | 432/95 |
| 6,481,946 | B1 | 11/2002 | Lonardi et al. | |
| 6,544,468 | B1 * | 4/2003 | Londardi et al. | 266/46 |
| 6,948,930 | B2 * | 9/2005 | Brzoska et al. | 432/95 |
| 7,267,266 | B2 * | 9/2007 | Rouille et al. | 235/380 |
| 7,861,614 | B2 * | 1/2011 | Sim | 74/469 |

FOREIGN PATENT DOCUMENTS

| | | |
|---|---|---|
| CS | 236410 | 6/1986 |
| CS | 236536 | 11/1986 |
| DE | 3342572 | 6/1984 |
| EP | 0863215 | 9/1998 |
| EP | 1453983 | 9/2004 |
| WO | 03050314 | 6/2003 |

* cited by examiner

ROTARY CHARGING DEVICE FOR A SHAFT FURNACE

TECHNICAL FIELD OF THE INVENTION

The present invention generally relates to a rotary charging device for a shaft furnace such as a metallurgical blast furnace. More particularly, the invention relates to achieving electric energy transfer from the stationary part to the rotatable part of the charging device.

BRIEF SUMMARY OF RELATED ART

Today, many metallurgical blast furnaces are equipped with a rotary charging device for feeding charge material into the furnace. Charging devices of the BELL LESS TOP type represent a particularly widespread example. Such a rotary charging device typically comprises a variably inclinable chute that is mounted on a rotatable support. In most currently used charging devices of this type, the variation of the chute inclination is achieved by means of a highly developed drive gear mechanism configured to transfer mechanical work from the stationary to the rotating part for varying the chute inclination.

In EP 0 863 215 it has been proposed to actuate the chute by means of an electrical motor arranged on the rotating part that supports the chute. This solution eliminates the need for a highly developed mechanical gear arrangement for varying the chute inclination. It does however require means for electric energy transfer, from the stationary part to the rotatable part, in order to power the electric motor on the rotatable chute support. The solution according to EP 0 863 215 is believed not to have found a widespread use because it is incomplete as far as such electric energy transfer is concerned both in terms of reliability despite the harsh blast furnace environment and in terms of low-maintenance requirements of means for achieving electric energy transfer.

A slip ring arrangement, as commonly found in electrical generators and electric motors, represents a well-known and widespread means for achieving electric energy transfer onto and from a rotatable part. Slip rings allow transmitting electric power of virtually any wattage to a rotating part. Their major drawback is that slip rings require frequent maintenance intervention, e.g. for cleaning and often require part replacement because of attrition. It will be understood that wear of slip rings is even more pronounced in the dusty and high temperature environment of a shaft furnace such as a blast furnace.

BRIEF SUMMARY OF THE INVENTION

The invention provides maintenance-friendly and reliable means for achieving electric energy transfer from the stationary part to the rotatable part in a rotary charging device for a shaft furnace.

A rotary charging device for a shaft furnace typically comprises a rotary distribution means for distributing charge material on a charging surface in the shaft furnace. A rotatable structure supports the rotary distribution means. The rotatable structure in turn is supported by a stationary support in a manner that allows rotation of this structure.

According to the present invention, the rotary charging device comprises an inductive coupling device. This inductive coupling device includes a stationary inductor fixedly mounted to the stationary support and a rotary inductor fixedly mounted to the rotatable structure. The stationary and the rotary inductor are separated by a radial gap. They are configured for achieving contact-less electric energy transfer, from the stationary support to the rotatable structure, by means of a shared magnetic field coupled in radial direction trough the gap. Hence, the inductors constitute a rotary transformer. Thereby, the coupling device provides a maintenance-friendly and reliable means for powering an electric load arranged on said rotary structure and connected to the rotary inductor.

By virtue of its contact-less design, the rotary transformer-type, inductive coupling device is not subject to wear by attrition and therefore virtually maintenance-free. It will be understood that a known circular slip-ring arrangement adapted for a shaft furnace charging device will have a considerable diameter, because of the required central passage for charge material (burden), whereby its wear is even more pronounced. This problem is eliminated by virtue of the power transmission device according to the present invention. Although a slightly lesser degree of power transmission efficiency may result from the interferric gap, especially when compared to slip-ring arrangements, this minor drawback is more than compensated by the considerable improvements in reliability and maintenance-friendliness.

As opposed to axially opposed inductors, as used in known rotary transformers for weak current applications, e.g. signal transmission applications (e.g. in VCRs), the invention proposes to arrange the interferric gap in radial direction, i.e. opposing the pole faces of the inductors radially with reference to the axis of rotation. In the specific case of charging devices arranged on a shaft furnace, it has been found that the range of tolerance for motion of the rotatable structure is normally larger in vertical direction than in radial direction. Therefore, a radially opposed relationship of the inductors allows minimizing the interferric gap.

For increased inductance, it is preferable that the stationary inductor comprises a stationary magnetic core arrangement and that the rotary inductor comprises a rotary magnetic core arrangement. The term arrangement is used to clarify that the respective cores need not necessarily be one-piece cores, as will become apparent hereinafter.

In an embodiment of the invention, the radial gap separates at least one, in general two or three, magnetic pole faces of the stationary core arrangement from at least one, in general two or three, magnetic pole faces of the rotary core arrangement such that the stationary magnetic pole faces and the rotary magnetic pole faces are arranged in radially opposed relationship. Although theoretically a single pole on one inductor being opposed to a single pole on the other inductor would be sufficient for achieving the function, it is preferred also to confine the return path of the magnetic flux. In a straightforward embodiment, the radial gap is substantially vertical, whereby any furnace dust deposits on the opposed faces are virtually impossible. Any dust or other potential deposit can fall through the gap without affecting the functioning of the power-coupling device.

Where parts requiring access, e.g. for maintenance purposes, would otherwise be obstructed by the inductive coupling device, a design is proposed in which the stationary inductor and/or the rotary inductor is discontinuous in the direction of rotation. In case of such discontinuous (i.e. not fully circular) configuration, the stationary inductor and the rotary inductor are preferably configured such that the total coupling surface for magnetic coupling between the stationary inductor and the rotary inductor is constant during rotation of the rotatable structure A necessary but non-sufficient condition for such constant coupling with discontinuous inductors is that at least one of the stationary inductor and the rotary inductor has a geometry that is rotationally symmetrical with respect to the axis of rotation of the rotatable structure. One possibility of achieving constant coupling while leaving access apertures is an embodiment in which the stationary inductor has at least one aperture in its circumference and the rotary inductor comprises at least one pair of separate sectors. Hence, both are discontinuous. In this embodiment, the aperture has a radian measure β and each pair of separate sectors is arranged such that the radian measure δ between the bisectors of this pair is such that δ is a divisor of β or such that β is a divisor of δ.

Preferably, each coil winding, of the stationary inductor and the rotary inductor respectively, has a turn number n in the range of $50 \leqq n \leqq 500$, and preferably $100 \leqq n \leqq 200$.

As will be appreciated by the skilled person, the inductive coupling device allows reliable and maintenance-friendly powering of an electric load, for example an electric motor operatively associated to the distribution chute for varying the angle of inclination of the distribution chute or for rotating the distribution chute about its longitudinal axis, of a cooling circuit pump, or any other electric load of considerable wattage (e.g. ≧500 W) arranged on the rotatable structure. For transmission of control and/or measurement signals it is not necessary to use the inductive coupling device. Instead, a radio transmitter, receiver or transceiver can be arranged on the rotatable structure for receiving and/or transmitting such signals to/from the load power by the coupling device.

The present invention is not limited in application to charging devices of the BELL LESS TOP type. Its use is beneficial also with other types of rotary charging devices. It will further be understood that a charging device, upgraded with the described inductive coupling device, is especially suitable for equipping a blast furnace. The skilled person will also appreciate that the disclosed coupling device can be readily retrofitted as an upgrade to existing charging devices without considerable structural modifications of the charging device.

BRIEF DESCRIPTION OF THE DRAWINGS

Further details and advantages of the present invention will be apparent from the following detailed description of several not limiting embodiments with reference to the attached drawings, wherein.

In these figures, identical reference numerals or reference numerals with incremented hundreds digit are used to indicate identical or corresponding elements throughout.

DETAILED DESCRIPTION OF THE INVENTION

Figure 1:
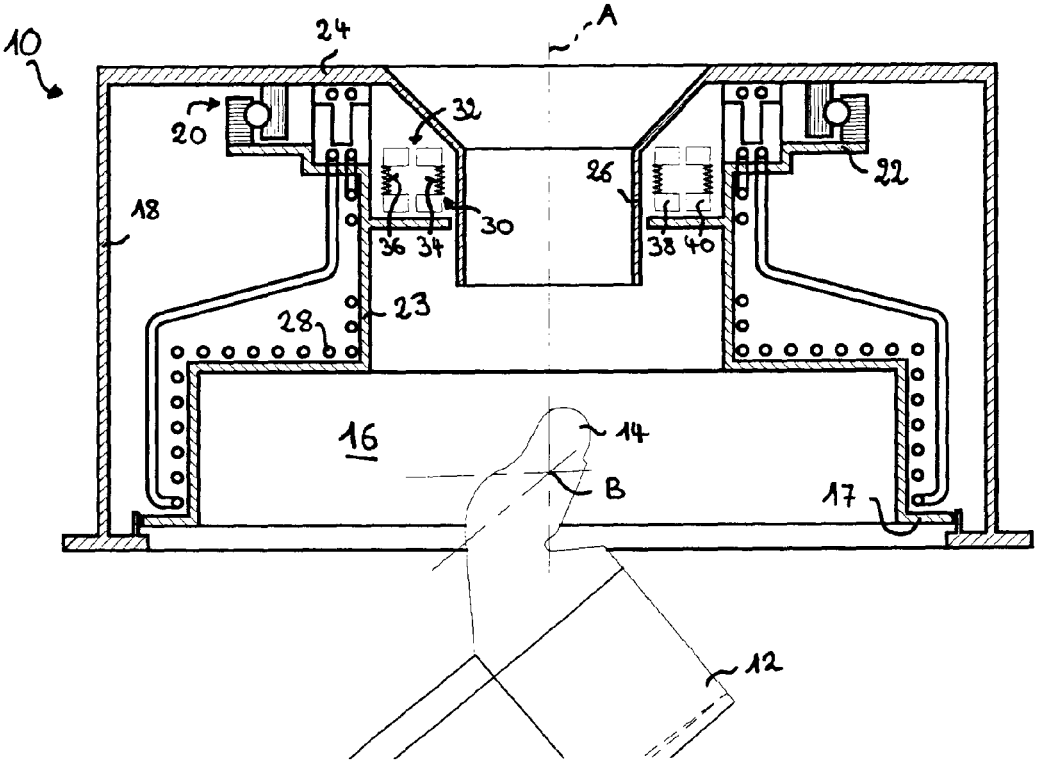
FIG. 1 is a vertical cross sectional view of a first embodiment of an inductive coupling device in a rotary charging device for a shaft furnace.

In FIG. 1, reference number 10 generally identifies a rotary charging device. The rotary charging device 10 will typically be installed on the throat of a shaft furnace (not shown) and in particular of a blast furnace for pig iron production. This charging device 10 comprises a rotary distribution means for distributing charge material on a charging surface in the hearth of the furnace. As part of the rotary distribution means, FIG. 1 shows a pivotable distribution chute 12 that is connected by means of duckbill-shaped mounting members 14 to a rotatable structure 16. The rotatable structure 16 has a lower support platform 17 (see FIG. 4) that supports an axle, forming axis B, on which the distribution chute 12 is suspended.

As seen in FIG. 1, the rotary charging device 10 also has a stationary support conceived as a housing 18. The rotatable structure 16 is rotatably supported in the housing 18 by means of large diameter roller bearings 20. The outer race of roller bearings 20 is fixed to a top end flange 22 of the rotatable structure 16 whereas the inner race of roller bearings 20 is fixed to a top plate 24 of the stationary housing 18. The roller bearings 20 are configured so that the rotatable structure 16 and therewith the distribution chute 12 can rotate about a substantially vertical axis A, which usually coincides with the central axis of the furnace. A central feeder spout 26 is centered on axis A and defines a passage through the top end flange 22 and through a tubular member 23 connecting the top end flange 22 to the support platform 17 of the rotatable structure 16. Charge material, such as ore and coke, can be fed through the feeder spout 26 onto the distribution chute 12. A cooling circuit 28, which has cooling serpentines in FIG. 1, is arranged on the rotatable structure 16 for protecting the parts particularly exposed to furnace heat.

According to the BELL LESS TOP principle developed by PAUL WURTH S. A. Luxembourg, the charging device 10 achieves distribution of charge material by rotating the distribution chute 12 about axis A and by varying the pivoting angle of the distribution chute 12 about axis B. Axis B is generally perpendicular to axis A. Further known details of the mechanism for rotating and pivoting the distribution chute 12 are not shown in the figures and not further described herein. A more detailed description of such details is given e.g. in U.S. Pat. No. 3,880,302. For ease of understanding, it should mainly be noted that the rotary charging device 10 comprises a rotatable structure 16 that is able to rotate relative to its stationary support, which in FIG. 1 corresponds to housing 18.

Those skilled in the art will appreciate that availability of electric power on the rotatable structure, especially if reliable and maintenance friendly, would be beneficial for various known applications but also for innovative new applications. Illustrative applications are for example:

- charging devices according to EP 0 863 215 or U.S. Pat. No. 6,481,946, which have an actuator for varying the pivoting angle of the distribution chute mounted on the rotatable structure and therefore require power to be available on the rotatable structure;
- one or more coolant pumps e.g. for a forced circulation cooling circuit 28 as shown in FIG. 1 or for the cooling circuit of a chute suspension axle as known from DE 33 42 572, and/or for the cooling circuit of the chute 12 itself as known from U.S. Pat. No. 5,252,063.

a charging device with a distribution chute that is rotatable about the longitudinal axis of the chute, as known from EP 1 453 983;

automated lubrication devices;

any other actuator(s) and/or sensor(s) beneficially provided on the rotating part of the charging device.

In the nature of things, measurement or control signals of actuators or sensors have low wattage (several mW or W) and can therefore simply be transmitted by wireless communication, e.g. using suitable standard radio equipment. In contrast, power supply for many applications has considerable wattage, typically in the order of 1 kW and above for electric motors, and therefore requires an appropriate means for achieving electric energy transfer from the fixed to the rotating part of the charging device 10.

In FIG. 1, reference number 30 identifies a first embodiment of an inductive coupling device, which is schematically shown in cross-section, for achieving such electric energy transfer. The inductive coupling device 30 enables contactless electric energy transfer from the stationary support 18 to the rotatable structure 16 by means of magnetic coupling through a radial gap 32.

The inductive coupling device 30 comprises a stationary inductor 34 that is fixed to the stationary support, i.e. the housing 18 in FIG. 1, and a rotary inductor 36 that is fixed to the rotatable structure 16. During operation of the charging device 10, the stationary inductor 34 remains immobile with the housing 18 whereas the rotary inductor 36 rotates together with the rotatable structure 16. Although not shown in FIG. 1, it will be understood that the stationary inductor 34 is cable-connected to a stationary circuit with an electric power source whereas the rotary inductor 36 is cable-connected to a circuit arranged on the rotatable structure 16 for powering an electric load such as a pivoting motor for the chute 12 and/or a pump for the cooling circuit 28 and/or any other desirable electrical appliance arranged on the rotatable structure 16. As shown in cross-section in FIG. 1, the stationary inductor 34 comprises a stationary magnetic core arrangement 38 and wire windings coiled around a portion of the core arrangement 38. Similarly, the rotary inductor 36 comprises a rotary magnetic core arrangement 40 and wire windings coiled around a portion of the core arrangement 40.

In the embodiment of FIG. 1, the coupling device 30 is arranged in between the feeder spout 26 and the tubular member 23. Due to this location, both core arrangements 38, 40 can be arranged around axis A as uninterrupted, that is to say fully circumferential, rings of comparatively small diameter (full circle configuration). The respective pole faces of the stationary and rotary magnetic core arrangements 38, 40 are separated by the radial gap 32 that forms a substantially vertical interferric air gap between the magnetic pole faces of each core arrangement 38, 40. The gap could also be slightly oblique in vertical section and need not necessarily be in a straight line for each pole face. A small radial gap 32 is however required in order to enable free rotation of the rotary inductor 36 relative to the stationary inductor 34.

By virtue of the radial gap 32, the radially opposed relationship of the pole faces of the magnetic core arrangements 38, 40 provides inter alia the following advantages:

reliable operation in case of typically occurring minor vertical displacement of the rotatable structure 16 relative to the housing 18 (e.g. due to wear of bearings 20 or due to furnace pressure variations);

avoidance or at least reduction of possible dust deposit on the pole faces of the core arrangements 38, 40 and subsequent blocking and wear;

(with large sized inductors 34, 36 of considerable axial coil length:) space saving in radial direction, with respect to axis A.

Figure 2:
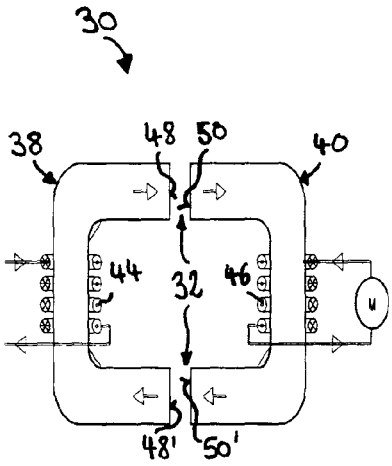
FIG. 2 is a vertical cross sectional view of a basic variant of an inductor and core arrangement in an inductive coupling device according to the invention.

FIG. 2 shows an embodiment of the inductive coupling device 30 in more detail. The inductive coupling device 30 is designed for single-phase alternating current (AC). The stationary magnetic core arrangement 38 and the rotary magnetic core arrangement 40, each comprise a substantially U-shaped or C-shaped core. The core arrangements 38, 40 are made of ferromagnetic material (e.g. ferrite) or alloy (e.g. Fe—Si) having a high relative permeability $\mu_r$, e.g. in the order of 7000 (at <0.1 mT flux density). PERMALLOY alloys that achieve very high relative permeability values of 40,000 or even 100,000 can also be used. High permeability allows confining the magnetic field and thereby increasing the inductance of each inductor 34, 36. The stationary and the rotary inductors 34, 36 comprise respective cylindrical coil windings 44, 46, each wound around a vertical portion of the corresponding core arrangement 38, 40, whereby space savings in radial direction with respect to axis A are achieved.

In the direction of rotation, i.e. in a plane perpendicular to that of FIG. 2, the windings 44, 46 may encircle substantially the entire circumference around axis A using a single cable bushing opening in a full circle core configuration as can be used in the embodiment of FIG. 1. For achieving a high ratio of winding number per coil length (N/l with N: number of turns and l: coil length of the winding) and thereby increasing inductance, it is however generally preferable that a given coil winding covers only part of the arc length of a respective core arrangement 38, 40 (or of a subcomponent thereof). This can be achieved e.g. with radial cable bushing openings at appropriate locations in the core arrangements 38, 40 for delimiting the arc length of a winding. In the latter case, each of the core arrangements 38, 40 has a plurality of such winding sectors. All winding sectors preferably have the same winding number (N). They are connected, preferably in series, with other winding sectors to an AC source or load respectively.

In each inductor 34, 36 the direction of the magnetic flux, as indicated by arrows in FIG. 2, is independent of the rotational position of the rotary inductor 36. In other words, the upper pole face 48 of the stationary core 38 remains opposed to the upper pole face 50 of the rotary core 40 whereas the same holds for the respective lower pole faces 48' 50'. Furthermore, the inductive coupling device 30 is configured such that the total magnetic flux densities through each inductor 34, 36 remain substantially constant during rotation of the rotary inductor 36. That is to say, electric energy transfer is substantially independent of the relative rotational position between the stationary and rotary inductors 34, 36. This is, of course, except for negligible variations e.g. due to cable bushing openings in the core arrangements 38, 40. Within the radial gap 32, the magnetic flux is also substantially radial as illustrated by arrows shown FIG. 2.

Where useful, dummy magnetic conducting elements (devoid of windings) can be inserted at certain locations in the circumference of the core arrangements 38, 40, in order to maintain a uniform magnetic flux density in the direction of rotation by minimizing stray field effects. Since the radially inner core arrangement (e.g. the stationary core arrangement 38 in FIG. 1 or the rotary core arrangement in FIG. 4-9) will have a slightly smaller diameter, the inductive coupling device 30 is designed such that the magnetic core with smallest flux cross section will not saturate.

The inductive coupling device operates like a (core type) transformer with the stationary coil windings 44 and the rotary windings 46 working as primary and secondary respectively. Hence, the voltage available on the taps of the rotary winding 46 depends on the winding ratio and the magnetic flux density. In the inductive coupling device 30, it is however generally independent of the rotational position of the rotatable structure 16. Since voltage transformation is not the basic purpose of the inductive coupling device 30, the winding ratio (of stationary turns to rotary turns) can be equal to 1, as in a one-to-one transformer. Due to the presence of the radial interferric air gap 32 between upper and lower pole faces 48, 50; 48' 50', the transmission efficiency of the inductive coupling device 30 is smaller than that of a conventional transformer with a continuous core. The radial width of the air gap 32 is small, normally in the order of several tenths of millimeters or a few millimeters (e.g. 0.5-5 mm). The interferric width depends on the minimum value that reliably warrants free rotation of the rotary inductor 36 taking into account the relevant factors such as thermal dilatation and play of the bearings 20.

FIG. 2 also schematically shows an example of a load (motor M) to be arranged on the rotatable structure 16. Any type of load can be supplied with electric power by virtue of the inductive coupling device 30. It will also be appreciated that the coupling device 30 provides for constant electric power transmission both during rotation of the rotatable structure 16 at different speeds, i.e. during operation, but also during standstill of the charging device 10.

Figure 3:
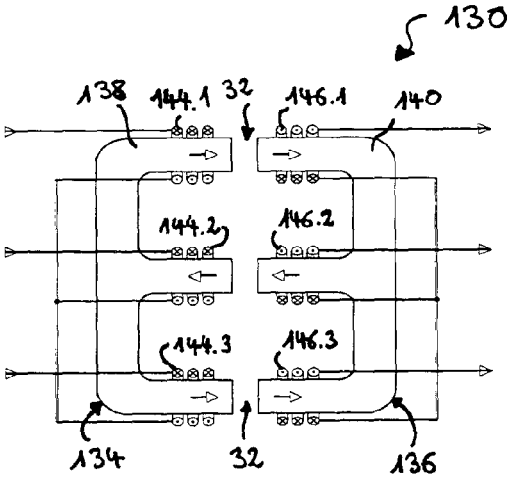
FIG. 3 is a vertical cross sectional view of a three-phase variant of an inductor and core arrangement of an inductive coupling device according to the invention.

FIG. 3 shows an alternative inductive coupling device 130 designed as symmetric three-phase system as conventionally used for high power applications. In the embodiment of FIG. 3, the coupling device 130 comprises stationary and rotary core arrangements 138, 140 of substantially E-shaped vertical cross-section, each having three magnetic pole faces. The stationary and rotary inductors 134, 136 respectively comprise a set of three coils 144.1, 144.2, 144.3; 146.1, 146.2, 146.3, each coil of a set operating at a 120° phase shift, for symmetrical three-phase AC power transmission. Stationary coils 144.1, 144.2, 144.3 are wound around each of the three horizontal branches of the stationary core arrangement 138 respectively whereas rotary coils 144.1, 144.2, 144.3 140 are wound around the opposed horizontal branches of the rotary core arrangement 140. Other aspects of the inductive coupling device 130 are similar to those described above and hereinafter.

FIGS. 4-9 show a further embodiment of an inductive coupling device 230 equipping a charging device 10. Those details of the charging device 10 of FIGS. 4-9 that correspond to those described in relation to FIG. 1 are not repeated hereinafter.

Figure 6:
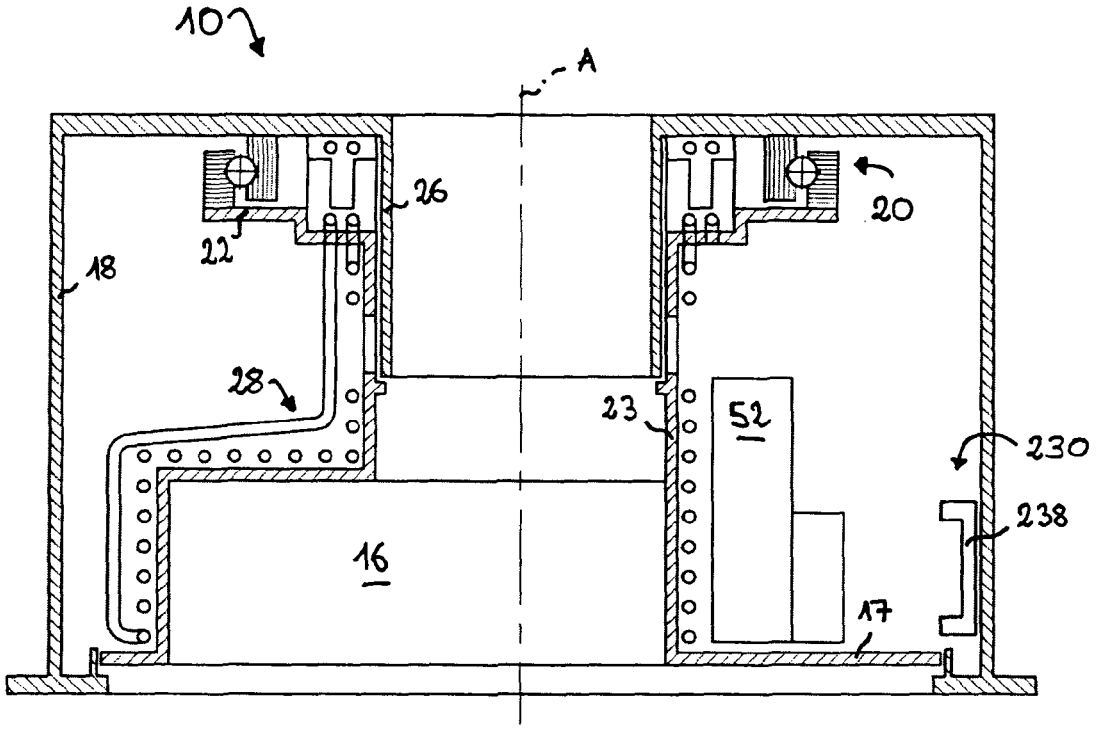
Figure 7:
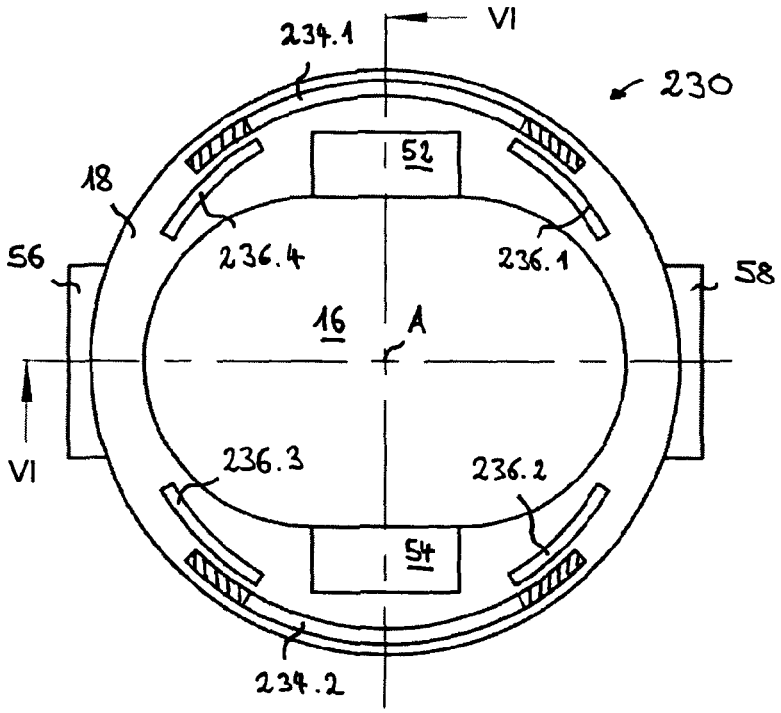
Figure 8:
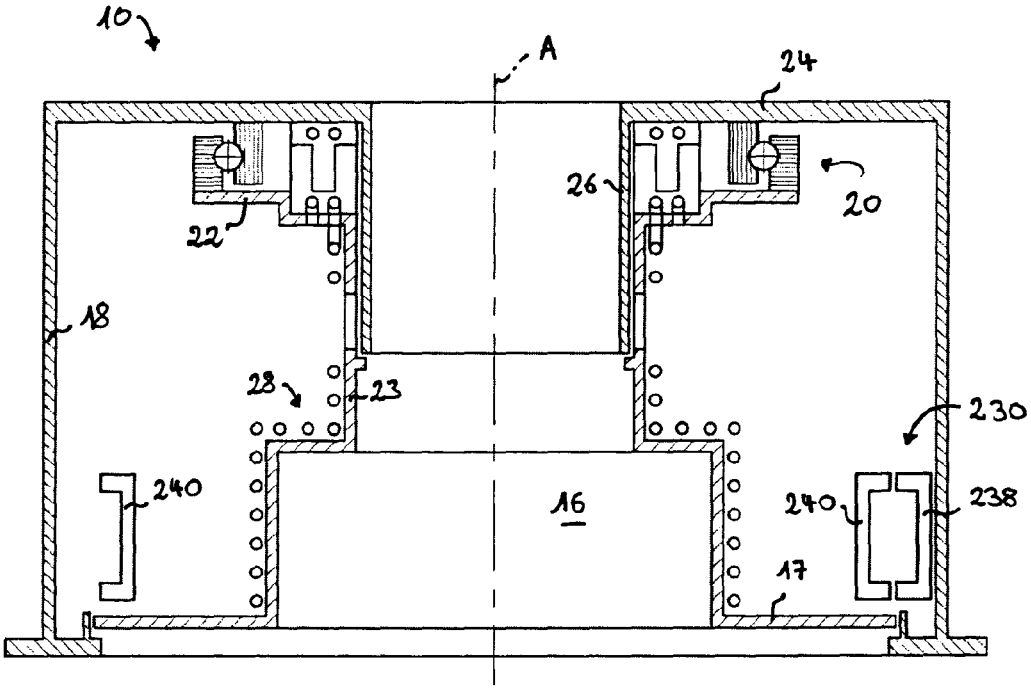

The inductive coupling device 230 of FIGS. 4-9 is arranged in the lower part of the stationary housing 18 as best seen in FIG. 8. Similar to the coupling devices described hereinbefore, the inductive coupling device 230 comprises a stationary inductor 234 with a magnetic core arrangement 238 and a rotary inductor 236 with a magnetic core arrangement 240. The core arrangements 238, 240 and their coil windings are dimensioned for higher wattage power transmission when compared to the embodiment in FIG. 1. Since the coupling device 230 is in the lower part of the housing 18, rotary inductor 236 is supported directly on the platform 17, whereas the stationary inductor 234 is fixed to the wall of housing 18. As appears from FIGS. 5, 7 & 9, the stationary core arrangement 238 is on the outside whereas the rotary core arrangement 240 is arranged on the inside with respect to axis A. Although not shown in detail, both core arrangements 238, 240 are provided with respective coil windings.

Figure 5:
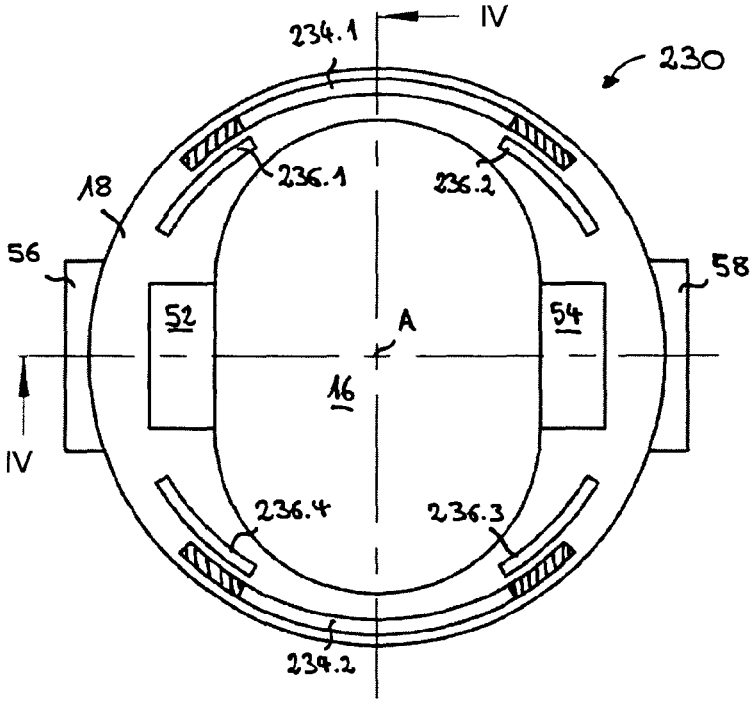
Figure 9:
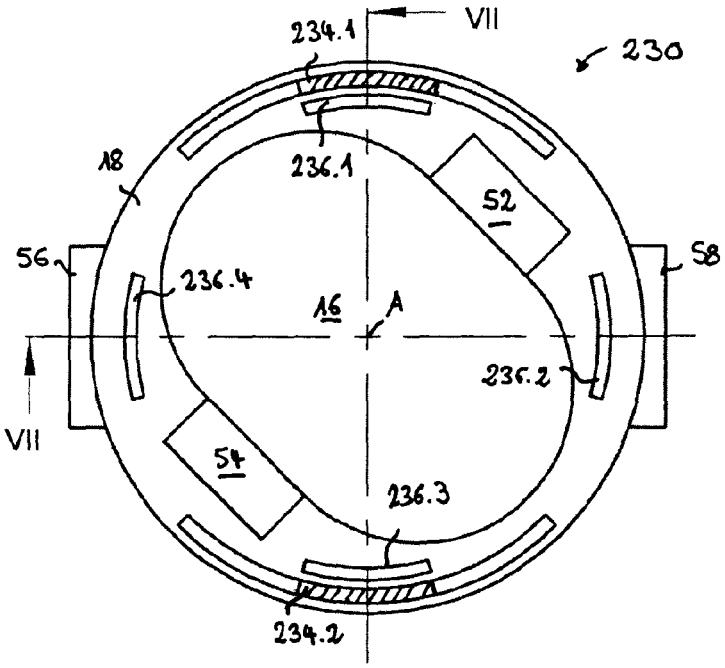

As seen in FIGS. 5, 7 & 9, both the stationary and rotary inductors 234, 236 and their respective stationary and rotary magnetic core arrangements 238, 240 are discontinuous in the direction of rotation of the rotatable structure 16 (discontinuous circle configuration). The stationary inductor 234 is composed of two sectors 234.1, 234.2 whereas the rotary inductor 236 is composed of four sectors 236.1, 236.2, 236.3 & 236.4. The sectors 234.1, 234.2; 236.1, 236.2, 236.3 & 236.4 are arranged in rotationally symmetry with respect to axis A. Only the opposing faces of the stationary and rotary magnetic core arrangements 238, 240 need to be machined with high precision in order to achieve a circular horizontal section. It will also be noted that, in plan view, the radial gap 32 is circular and centered onto axis A.

As further seen in FIGS. 5, 7 & 9, respective apertures in the circumference of the magnetic core arrangements 238, 240 allow accessing internal parts on the rotatable structure 16, e.g. for maintenance interventions, without dismantling the inductive coupling device 230. For example, access is given to both halves of the support and driving mechanism of the distribution chute 12, schematically shown at reference numbers 52, 54, but also to the cooling circuit 28 or its coolant pump (not shown) for example. In the rotational configuration of FIG. 5 for example, both halves of the support and driving mechanism 52, 54 arranged on the support platform 17 can be accessed through access doors 56, 58 in the housing 18. In the rotational configuration of FIG. 7 for example, the rotatable structure is rotated by 90° clockwise with respect to FIG. 5 such that other parts, e.g. part of the cooling circuit 28 seen in the left-hand side of FIG. 6, can be accessed. FIG. 9 shows an intermediate rotational position of the rotatable structure 16. A circumferentially interrupted coupling device 230 may also be used in view of constructional constraints.

The height of the vertical portion of the substantially U-shaped parts of the magnetic core arrangements 238, 240 accommodates a large number of coil windings (not shown) for achieving considerable inductance, since inductance increases with the square of the winding number. The arrangement of FIGS. 4-9 is appropriate for high power applications, e.g. loads requiring >10 kW electric power supply.

Figure 4:
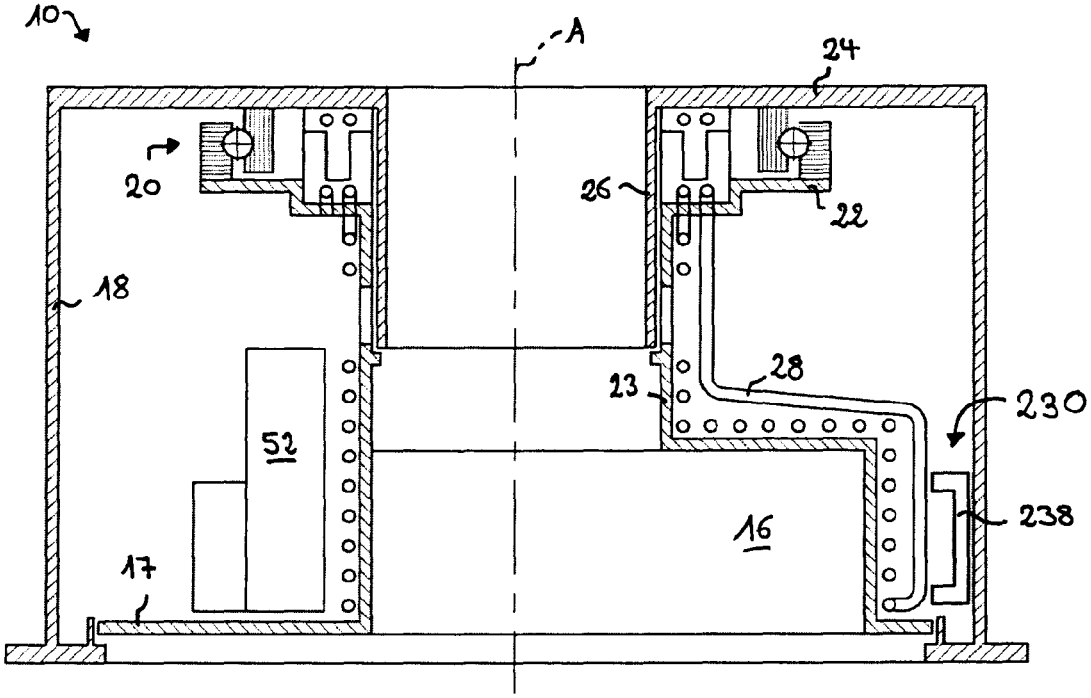
FIGS. 4, 6, 8 are vertical cross sectional views along lines IV-IV, VI-VI and VIII-VIII of the schematic plan views of FIGS. 5, 7, 9 respectively, illustrating another embodiment of an inductive coupling device, with FIGS. 4-5, 6-7, 8-9 respectively showing different rotational positions.

As seen in the vertical cross-sections of FIGS. 4, 6 & 8, a given pole face portion of the stationary magnetic core arrangement 238 is not at all times opposed to a corresponding pole face portion of the rotary magnetic core arrangement 240 during a given cycle of rotation. As will be appreciated from a comparison of FIGS. 5, 7 & 9, the total coupling surface for magnetic coupling through the radial gap 32 remains constant during rotation of the rotary inductor 236, i.e. independent of the rotational position of the rotary inductor 236 relative to the stationary inductor 234. In the present context, the term coupling surface is defined as that surface on which pole faces (see 48, 50; 48', 50' in FIG. 2) of the stationary core arrangement 238 are radially opposed to pole faces of the rotary core arrangement 240 and vice versa, i.e. the surface area through which effective magnetic coupling can be achieved. Consequently, in the embodiment of FIGS. 4-9, the total coupling surface is the sum of such separate surfaces given by the radian measure of the opposed portions (hatched in FIGS. 5, 7 & 9) of sectors 234.1, 234.2; 236.1, 236.2, 236.3 & 236.4, respectively multiplied by the summed vertical height of the corresponding pole faces (see 48, 50; 48', 50' in FIG. 2).

As a consequence of the total coupling surface being constant independently of the rotational position, the coupled magnetic flux and hence electric power transferred to the rotatable structure 16 is also independent of rotational position of the latter, despite the discontinuous configuration of the stationary and rotary inductors 234, 236 according to FIGS. 4-9. With an appropriate diameter of the inductive coupling device 230, a degree of magnetic coupling similar to that of a continuous configuration of smaller diameter (e.g. according to FIG. 1) can be achieved with the discontinuous configuration of the coupling device 230 of FIGS. 4-9.

Figure 10:
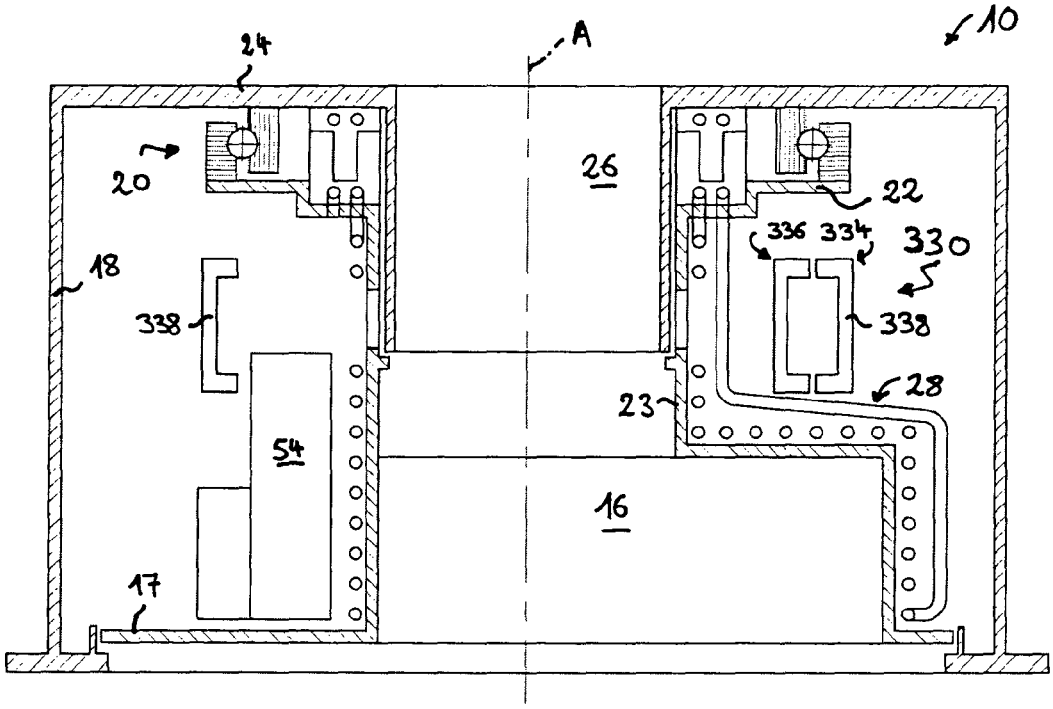
FIG. 10 is a vertical cross sectional view along line X-X of the schematic plan view of FIG. 11, illustrating a further embodiment of an inductive coupling device in a rotary charging device.
Figure 11:
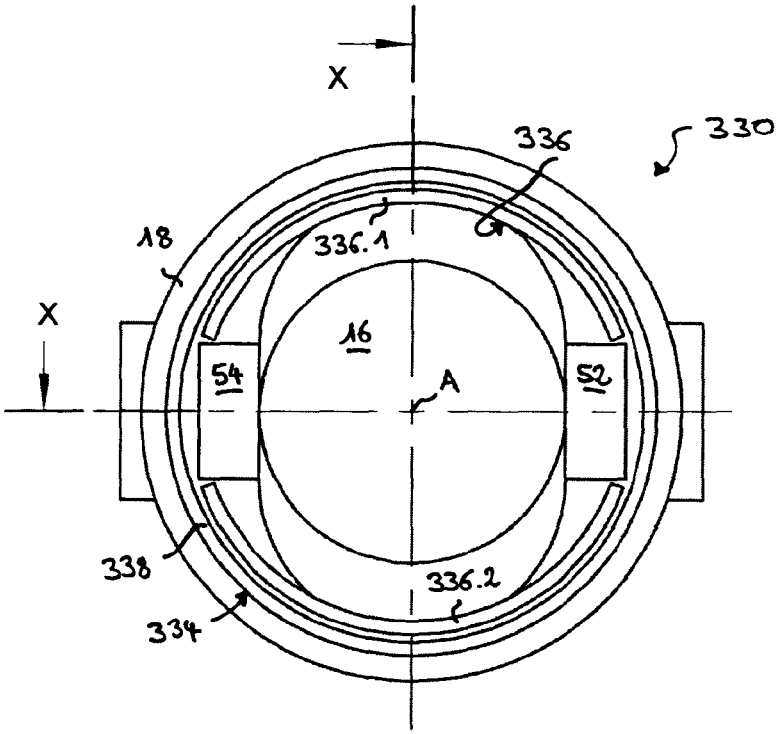

FIGS. 10-11 show a further embodiment of an inductive coupling device 330 equipping a charging device 10. The coupling device 330 has a discontinuous configuration. Only the differences with respect to the previously described embodiments will be detailed below.

As seen in FIG. 10, the inductive coupling device 330 is arranged at intermediate height within the housing 18. This location enables reducing the device diameter and hence material cost, approaching the roller bearings 20 such that the required width tolerance of the gap 32 is smaller, and reducing exposure to furnace dust and heat. As opposed to the coupling device 230, only the rotary inductor 336 of the inductive coupling device 330 is discontinuous in the direction of rotation whereas the stationary inductor 334 is configured as a full circle ring about axis A. The diameter of the coupling device 330 is slightly reduced compared to that of FIGS. 4-9. As seen in FIG. 11, the rotary inductor 336 is composed of two distinct circular arc shaped sectors 336.1, 336.2. Sectors 336.1, 336.2 are separated by apertures only at the location of the two opposite halves of the support and driving mechanism 52, 54. The discontinuous rotary inductor 336 complies with constructional space constraints of the charging device 10 and facilitates access to the support and driving mechanism 52, 54. By virtue of the considerable total coupling surface apparent from FIG. 11 (opposed portions are hatched), the inductive coupling device 330 allows contactless electric energy transfer of even higher wattage compared to the previous embodiments. It will be understood that the specific electrical design of the schematically shown coupling device 230, 330 may correspond to that of FIG. 2, that of FIG. 3, or any other suitable electrical design readily appreciated by the skilled person.

Figure 12:
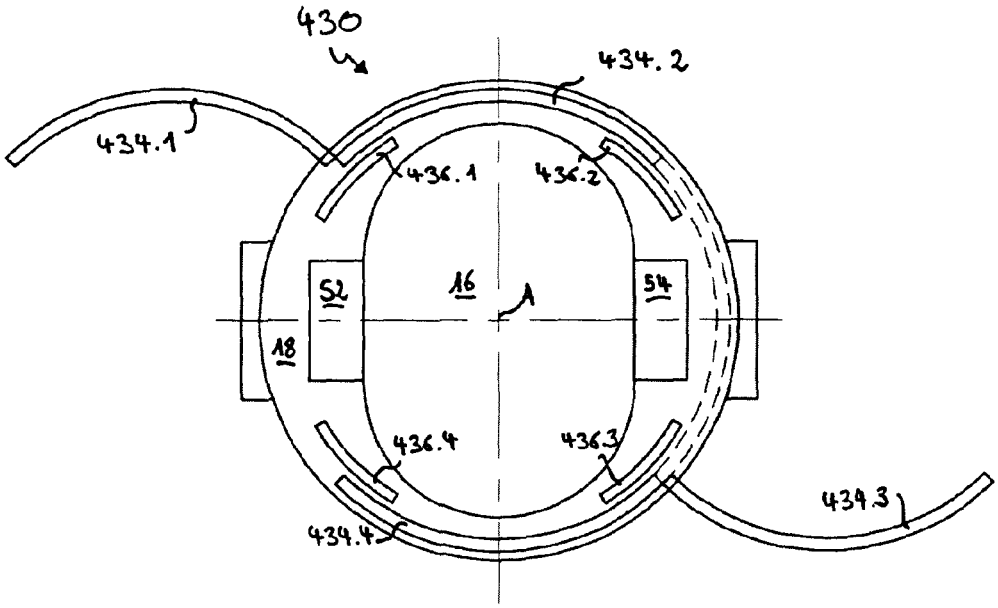
FIG. 12 is a plan view of a further embodiment of an inductive coupling device in a rotary charging device.
Figure 16:
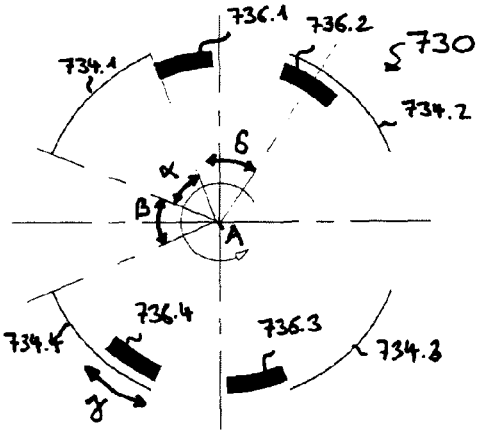

FIG. 12 shows a further embodiment of a coupling device 430 that can be considered as a variant of the embodiment illustrated in FIGS. 4-9. As opposed to the latter embodiment, the coupling device 430 has a stationary inductor 434 that is configured as a full circle ring centered on axis A. In order to achieve accessibility for maintenance purposes, the stationary inductor 434 has removable sectors 434.1, 434.3. The latter can for example be mounted on hinges to be pivotable relative to fixedly mounted sectors 434.2, 434.4 as indicated in FIG. 16. When access is required, e.g. to the support and driving mechanism parts 52, 54, the hinged sector portions 434.1 and 434.2 are moved into a parking position shown in FIG. 16. During operation, the removable sector portions 434.1 and 434.3 are positioned (see broken lines in FIG. 16) to form a full circle ring together with the fixed sectors 434.2, 434.4. Since the magnetic flux direction in the magnetic core arrangements 438, 440 is perpendicular to the direction of rotation, an interruption of the magnetic core arrangement at the interfaces between removable sectors 434.1, 434.3 and fixed sectors 434.2, 434.4 is not critical.

Since the speed of rotation of a rotary charging device for a shaft furnace is comparatively low (e.g. several revolutions per minute), special measures need to be taken to achieve constant electric energy transfer with discontinuous inductors. Therefore, further details regarding possible discontinuous circle configurations of inductive coupling devices are described hereinafter with respect to FIGS. 13-19. Initially, it should be noted that each of FIGS. 13-19 illustrates an example of a discontinuous inductive coupling device enabling constant electric energy transfer irrespective of rotation of the rotatable structure 16. These examples are neither exhaustive nor intended to be limitative.

Figure 13:
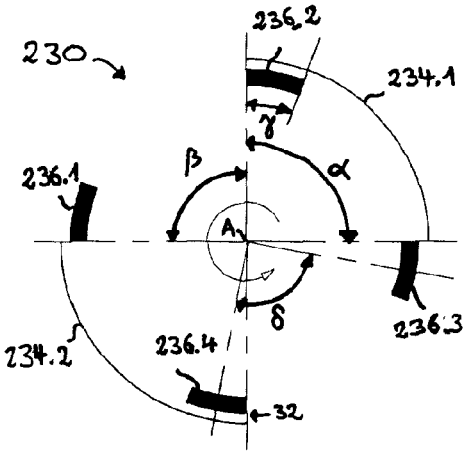
FIGS. 13-19 are schematic plan views illustrating possible geometric configurations and further variants of an inductive coupling device.

FIG. 13 schematically illustrates the geometric configuration of the circumferentially interrupted, i.e. discontinuous circle coupling device 230 shown in FIGS. 4-9. As seen in FIG. 1, both sectors 234.1, 234.2 of the stationary inductor 234 as well as the four sectors 236.1, 236.2, 236.3 & 236.4 of the rotary inductor 236 are arranged in rotational symmetry about axis A. The stationary inductor 234 has m-fold rotational symmetry (also called "discrete rotational symmetry of order m"), with m=2 (i.e. symmetrical by $2\pi/m=\pi$ or 180° rotation), whereas the rotary inductor 236 has n-fold rotational symmetry, with n=4 (i.e. symmetrical by $2\pi/n=\pi/2$ or 90° rotation). The respective radian measures $\alpha$ of the stationary sectors 234.1, 234.2 are identical and approximately equal to $\pi/2$ or 90°. The two apertures in between the stationary sectors 234.1, 234.2 also have identical radian measure $\beta$ approximately equal to $\pi/2$ or 90°. The radian measure $\gamma$ of the sectors 236.1, 236.2, 236.3 & 236.4 is a compromise value between desired electromagnetic coupling and access space, e.g. for maintenance. The value of $\gamma$ is in itself not critical for achieving constant inductive coupling. With given radius and symmetry orders, the respective radian measures, $\alpha$, $\beta$, $\gamma$ determine the arc lengths of the apertures and the stationary 234.1, 234.2 and rotary sectors 236.1, 236.2, 236.3 & 236.4, whereby among others the total coupling surface can be determined.

For alleviation of what follows, the expression "conjugated sectors" shall be used to refer to a given pair of rotary sectors that satisfy the condition of being the circumferentially closest pair in which one sector is simultaneously causing an increase in coupling when its conjugate is causing a decrease in coupling and vice versa. In the coupling device 230 of FIG. 13, the pairs (236.1, 236.2) and (236.3, 236.4) are pairs of conjugated sectors. The radian measure $\delta$ in between the centers of two conjugated sectors, e.g. 236.1 and 236.2, is chosen in function of the radian measure $\beta$ of the aperture(s). In the coupling device 230, $\delta$ is a divisor of $\beta$, i.e. $\beta=k\cdot\delta$ with k being a nonnegative integer. As seen in FIG. 13, k=1 or $\delta$ is approximately equal to $\pi/2$ or 90°. Furthermore, both conjugated sectors, e.g. (236.1, 236.2) and (236.3, 236.4), shall have identical radian measure $\gamma$ and be arranged symmetrical with respect to the plane defined by their bisector used to define $\delta$. Thereby it is ensured that the total coupling surface is independent of the rotational position of the rotary inductor 236. In fact the above conditions make sure that when the coupling surface at a given sector, say 236.2, is reduced or increased due to rotation, the coupling surface at its conjugated sector, say 236.1, is simultaneously reduced or increased by the same amount.

Figure 14:
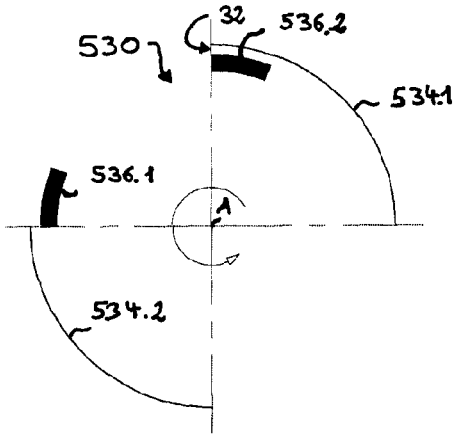

FIG. 14 shows a coupling device 530 according to a variant of the embodiment of FIGS. 4-9 & 13 in which the rotary inductor 536 comprises only one pair of conjugated rotary sectors 536.1 and 536.2. As seen in FIG. 14, the rotary inductor 536 need not necessarily be rotationally symmetrical about axis A (considering 1-fold symmetry not to be a symmetry). In certain configurations, it is sufficient that either one of the stationary or the rotary inductor 534, 536 has rotational symmetry, as illustrated also by FIG. 15.

Figure 15:
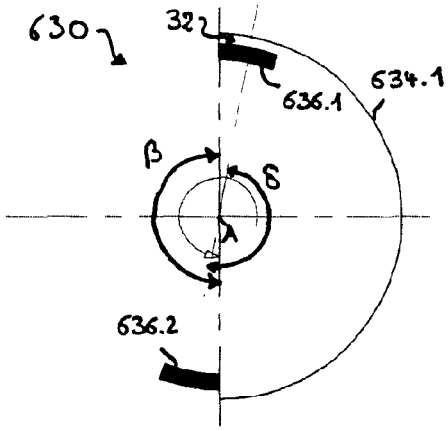

FIG. 15 shows a further example of a coupling device 630 having a single pair of rotary sectors 636.1 and 636.2 and only one stationary sector 634.1. In the coupling device 630 of FIG. 15, the rotary inductor 636 has 2-fold rotational symmetry (i.e. by $\pi$ or 180°) whereas the stationary inductor 634 is not rotationally symmetrical (m=1). In the coupling device 630 of FIG. 15, $\delta$ is a divisor of $\beta$ (and vice versa), i.e. $\beta=k\cdot\delta$ with k=1.

FIG. 16 shows a coupling device 730, in which the stationary inductor 734 is 4-fold rotationally symmetrical (m=4), whereas the rotary inductor 736 is not rotationally symmetrical (n=1). The stationary and rotary inductors 734, 736 respectively have four sectors 734.1, 734.2, 734.3 & 734.4 and 736.1, 736.2, 736.3 & 736.4. In the coupling device 730, $\alpha=\beta=\delta=\pi/4$ and hence $\beta=k\cdot\delta$ with k=1. Again, the radian measure $\gamma$ of the rotary sectors 736.1, 736.2, 736.3 & 736.4 may be increased or reduced without affecting the fact that electromagnetic coupling is independent of rotation. Within each pair of conjugated sectors (736.1, 736.2) and (736.3, 736.4) however, the radian measure $\gamma$, i.e. arch length, of both sectors shall be identical and satisfy $\gamma\leqq\beta$.

Figure 17:
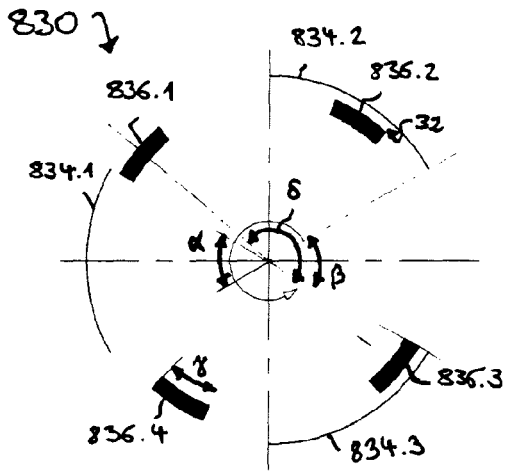

FIG. 17 shows a further alternative embodiment of a coupling device 830, in which the stationary inductor 834 is 3-fold rotationally symmetrical (m=3, i.e. symmetrical by 120° rotation), whereas the rotary inductor 836 is 4-fold rotationally symmetrical (n=4). The stationary inductor 834 comprises three separate sectors 834.1, 834.2 & 834.3, whereas the rotary inductor 836 comprises four distinct rotary sectors 836.1, 836.2, 836.3 & 836.4. The sectors are arranged in rotational symmetry about axis A. In the coupling device 830, $\alpha=\beta=2\pi/3$ whereas $\delta=\pi$. It shall be noted that the conjugated rotary sectors in the coupling device 830 are those that are radially opposed, i.e. sectors (836.1, 836.3) and (836.2, 836.4) are respectively conjugated. Hence in the embodiment of FIG. 17, $\beta$ is a divisor of $\delta$ (not vice versa!), i.e. $\delta=k\cdot\beta$ with k=3. In fact, in this particular embodiment, $\delta>\beta$ whereas in the preceding embodiments $\delta\leqq\beta$.

Figure 18:
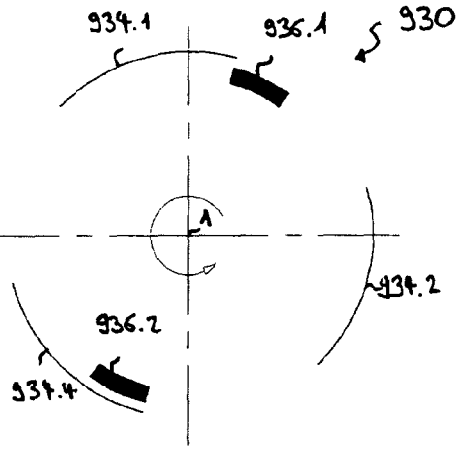

FIG. 18 shows a coupling device 930, which is a variant of the embodiment of FIG. 17 in that it has only one pair of conjugated sectors 936.1, 936.2 in the rotary inductor 936. It appears from the comparison of FIGS. 17&18 that the actual number of conjugated pairs that are used is not decisive as long as the conditions for rotation-independent coupling remain satisfied. For example, a further conjugated pair (not shown) could be added to the coupling device 830 of FIG. 17 by interposing two radially opposite sectors at 45° in between the sector pairs (836.1, 836.2) and (836.3, 836.4) without affecting rotational independence.

Figure 19:
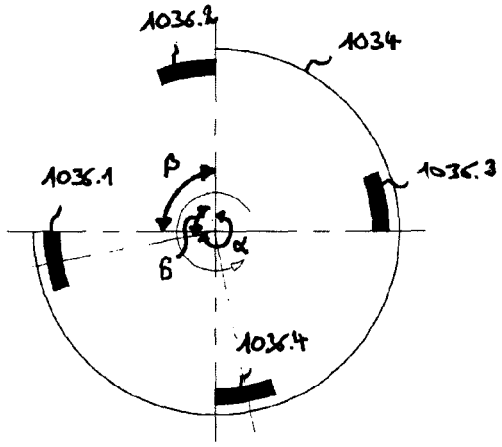

FIG. 19 shows a further embodiment of a coupling device 1030. In this coupling device, the rotary inductor 1036 has the same configuration as the rotary inductor of FIG. 13, i.e. it comprises four separate sectors 1036.1, 1036.2, 1036.3 & 1036.4 with $\delta=\pi/4$ and is arranged in 4-fold rotational symmetry (n=4) about its axis of rotation A. The stationary inductor 1034 on the other hand is formed in one piece of radian measure $\alpha=3\pi/4$ and therefore not rotationally symmetrical (m=1). The stationary inductor 1034 is discontinuous due to an aperture having a radian measure $\beta=\pi/4$. As in the preceding embodiments, electric energy transfer from the stationary inductor 1034 to the rotary inductor 1036 by means of magnetic coupling trough the radial gap 32 is also substantially constant during rotation of the rotary inductor 1036.

It follows from the above description of possible geometric arrangements of the coupling devices that many different configurations of inductors with discontinuous core arrangements are possible all being such that the total coupling surface is constant during rotation of the rotary inductor. Thereby electric energy transfer by magnetic coupling trough the radial gap 32 is independent of the rotational position of the rotatable structure 16 that supports the rotary inductor (except for small variations occurring at the edges of the sectors).

Figure 20:
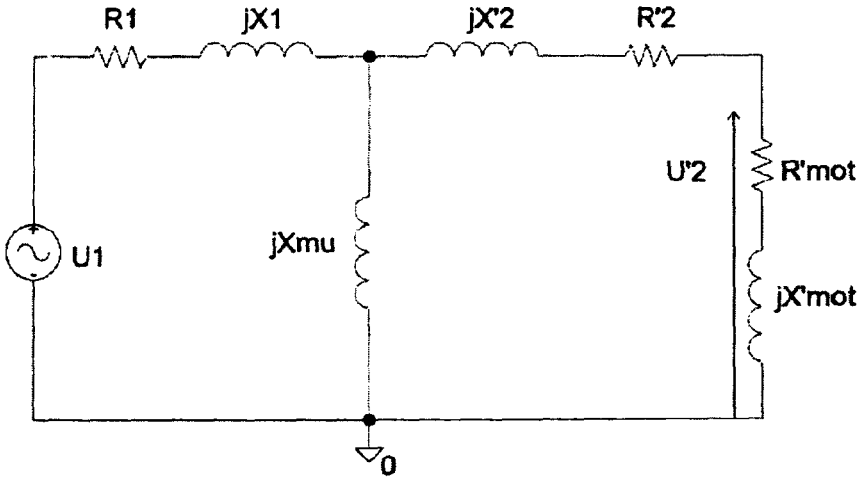
FIG. 20 is an equivalent circuit diagram of an inductive coupling device according to the invention.

Turning now to the equivalent circuit diagram of the inductive coupling device, shown in FIG. 20, some electrical design considerations will be detailed. In FIG. 20 (using phasor notation):

U1: voltage applied to the stationary inductor;

R1: winding resistance of the stationary inductor;

X1: leakage reactance of the stationary inductor;

U'2=$n_{tr}\cdot$U2: voltage at the rotary inductor referred to the stationary inductor;

R'2=$n_{tr}^2\cdot$R2: winding resistance of the rotary inductor referred to the stationary inductor;

X'2=$n_{tr}^2\cdot$X2: leakage reactance of the rotary inductor referred to the stationary inductor;

Xmu=magnetizing mutual reactance;

Z'mot=R'mot+jX'mot: impedance of the load (e.g. a motor) referred to the stationary inductor;

R'mot=$n_{tr}^2\cdot$Rmot: resistance of the load referred to the stationary inductor;

X'mot=$n_{tr}^2\cdot$Xmot: reactance of the load referred to the stationary inductor;

with $n_{tr}$ being the winding ratio of stationary turns to the rotary turns.

As will be understood, the inductive coupling device basically resembles that of a rotary transformer. Therefore, Xmu is an important parameter as regards the design of the inductive coupling device. In fact:

$$Xmu = 2\pi\cdot f\cdot\frac{n_1^2}{\Re_{core}+\Re_{gap}}, \tag{1}$$

with f being the AC frequency, $n_1$ being the number of turns at the stationary inductor winding and $\mathfrak{R}_{core}$, $\mathfrak{R}_{gap}$ being the core reluctance and the reluctance of the radial gap 32 respectively. Since the permeability of the core material is several thousand times larger than that of the radial gap 32, $\mathfrak{R}_{core}$ is negligible compared to $\mathfrak{R}_{gap}$ in equation (1). Because reluctance of the radial gap 32 is directly proportional to the width (i.e. radial extension) of the gap 32, this width should be minimized in order to warrant a high mutual inductance Xmu. Besides rendering Xmu as large as possible, rendering R1, R2 and the X1, X2 as small as possible, are measures for optimizing inductive coupling efficiency.

Using the equivalent circuit diagram of FIG. 20, effective efficiency of the inductive coupling device, based on the effective power ratios, can be calculated by:

$$\eta = \frac{R'mot}{R'mot + R'2 + R1\cdot\left(\frac{R'2 + jX'2 + jXmu + R'mot + jX'mot}{jXmu}\right)^2} \tag{2}$$

Apparent efficiency based on the ratio of effective power consumed by the load to apparent (effective+reactive) power consumed on the primary side is also a relevant performance measure. It is calculated by:

$$\eta_s = \frac{R'mot\cdot\overline{I_2}^2}{\overline{U_1}\cdot\overline{I_1}} \tag{3}$$

with $\overline{U_1}$ and $\overline{I_i}$ being apparent (effective+reactive) voltage and current on the stationary/rotary side respectively.

For a radial gap width of 1 mm, a Fe—Si core, 1 $mm^2$ winding copper wire cross-section with a 1 kW load, a turn number for each winding respectively in the range of $110<n_{1,2}<160$ has been found preferable. It should be noted that $\eta$ and $\eta_s$ cannot generally both be optimal for a given design, with $\eta_s$ having a maximum at higher turn numbers than $\eta$. Therefore, choosing the lowest number of turns at which a maximum of $\eta$ is obtainable, minimizes resistive heating losses. Since the reactances are function of the AC frequency it is understood that (2) is a function of the AC frequency at which the stationary inductor is supplied. It has been found that in the above exemplary design, $\eta$ and $\eta_s$ rapidly increase up to 150 Hz. Beyond this value, $\eta$ still increases but at a slope that is much less steep, whereas $\eta_s$ may significantly drop at higher frequencies. In order to minimize reactive losses (Xmu, core losses), frequency should be within a compromise range of 100 Hz<f<200 Hz. For a turn number $n_{1,2}$=125 of both the stationary and rotary inductor windings and a frequency of f=150 Hz, the following values have been numerically determined for different widths of the interferric radial gap 32:

| e [mm] | 0.5 | 1 | 2 | 5 |
|---|---|---|---|---|
| $\eta$ | 69.7 | 61.3 | 44.8 | 17.6 |
| $\eta_s$ | 46.7 | 35.6 | 22.6 | 9.2 |

As will be understood, the interferric width e of the radial gap 32 will generally be in the order of 0 mm<e<2 mm. Effective efficiency values above 70% are achievable at the expense of using larger winding wire cross-sections, using higher permeability core materials (e.g. PERMALLOY), enabling a smaller interferric width e and/or various other measures readily appreciated by the skilled person. As will be understood, any supplementary components can be used in combination with the inductive coupling device where necessary. The coupling device may be supplemented with energy storage and a rectifier or with an electric power controller. It will be appreciated that no electrical means beyond the electromechanical design disclosed herein are required to achieve substantially constant power supply to a load arranged on the rotatable structure 16.

Although the inductive coupling device could theoretically be used for combined signal and power transmission, it is considered preferable to use radio equipment for signal transmission. Hence, a radio transmitter, receiver or transceiver can be arranged on the rotatable structure 16 for receiving and/or transmitting control and/or measurement signals from or to the load connected to the rotary inductor. Both the load and the radio equipment can be powered via the coupling device.

Finally, it will be appreciated that a shaft furnace charging device upgraded with an inductive coupling device descried hereinbefore, is ready to receive any type of electric load arranged on the rotatable structure. Due to the high power capacity of the coupling device, one or more loads having nominal power consumption well above 500 W can be conveniently and reliably operated on the rotating part of the charging device, irrespective of the operating conditions. By virtue of its contact-less design, the inductive coupling device will not suffer from wear and it is therefore virtually maintenance free despite the harsh operating conditions of a shaft furnace.

The invention claimed is:

1. A charging device for a shaft furnace, comprising:

a rotary distribution means for distributing charge material on a charging surface in a shaft furnace;

a rotatable structure which supports said rotary distribution means;

a stationary support which supports said rotatable structure;

an electric load arranged on said rotatable structure; and a rotary transformer-type inductive coupling device for powering said electric load said inductive coupling device comprising:

a stationary inductor fixed to said stationary support and a rotary inductor fixed to said rotatable structure, said electric load being connected to said rotary inductor, wherein said stationary inductor and said rotary inductor are separated by a radial gap and configured to achieve contact-less electric energy transfer by coupling a magnetic field through said radial gap.

2. The charging device according to claim 1, wherein said stationary inductor comprises a stationary magnetic core arrangement having at least one stationary magnetic pole face and said rotary inductor comprises a rotary magnetic core arrangement having at least one rotary magnetic pole face and wherein said radial gap separates said at least one stationary magnetic pole face from said at least one rotary magnetic pole face such that said at least one stationary magnetic pole face and said at least one rotary magnetic pole face are arranged in radially opposed relationship.

3. The charging device according to claim 2, wherein said radial gap is substantially vertical.

4. The charging device according to claim 1, wherein at least one of said stationary inductor and said rotary inductor is discontinuous in the direction of rotation.

5. The charging device according to claim 4, wherein said stationary inductor and said rotary inductor are configured such that the total coupling surface for magnetic coupling between said stationary inductor and said rotary inductor is constant during rotation of said rotatable structure.

6. The charging device according to claim 5, wherein at least one of said stationary inductor and said rotary inductor has a geometry that is rotationally symmetrical with respect to the axis of rotation of said rotatable structure.

7. The charging device according to claim 6, wherein said stationary inductor has at least one aperture in its circumference whereby it is discontinuous, said aperture having a radian measure $\beta$ and wherein said rotary inductor comprises at least one pair of separate sectors arranged such that the radian measure $\delta$ between the bisectors of said at least one pair is such that $\delta$ is a divisor of $\beta$ or such that $\beta$ is a divisor of $\delta$.

8. The charging device according to claim 2, wherein said stationary inductor and said rotary inductor respectively comprise at least one inductor winding having a turn number n in the range of $50 \leqq n \leqq 500$.

9. The charging device according to claim 1, wherein said rotary distribution means comprises a distribution chute that is pivotable about a substantially horizontal axis and further comprising an electric motor operatively associated to said distribution chute for varying the pivoting angle of said distribution chute, said electric motor being connected as a load to said rotary inductor.

10. The charging device according to claim 1, wherein said rotary distribution means comprises a distribution chute that is rotatable about a longitudinal axis of said distribution chute and further comprising an electric motor operatively associated to said distribution chute for rotating said distribution chute about its longitudinal axis, said electric motor being connected as a load to said rotary inductor.

11. The charging device according to claim 1, further comprising a cooling circuit comprising a pump arranged on said rotatable structure, said pump being connected as a load to said rotary inductor.

12. The charging device according to claim 1, wherein said electric load has a nominal power consumption>500 W.

13. The charging device according to claim 1, further comprising at least one of a radio transmitter, a radio receiver and a radio transceiver arranged on said rotatable structure.

14. A charging device for distributing charge material on a charging surface, said charging device comprising:

a distribution chute;

a rotatable structure which supports said distribution chute;

a stationary support which supports said rotatable structure;

an inductive coupling device configured for contact-less electric energy transfer, said coupling device comprising:

a stationary inductor fixed to said stationary support and a rotary inductor fixed to said rotatable structure;

said stationary inductor and said rotary inductor being separated by a radial gap and configured for coupling a magnetic field through said radial gap; and an electric load arranged on said rotatable structure and connected to said rotary inductor for being powered via said inductive coupling device.

15. The charging device according to claim 14, wherein said stationary inductor comprises a stationary magnetic core arrangement having at least one stationary magnetic pole face and said rotary inductor comprises a rotary magnetic core arrangement having at least one rotary magnetic pole face, said radial gap being substantially vertical and separating said at least one stationary magnetic pole face of said stationary core arrangement from said at least one rotary magnetic pole face of said rotary core arrangement such that said at least one stationary magnetic pole face and said at least one rotary magnetic pole face are arranged in radially opposed relationship.

16. The charging device according to claim 15, wherein said stationary inductor and said rotary inductor each respectively comprise at least one inductor winding having a turn number n in the range of $50 \leqq n \leqq 500$.

17. The charging device according to claim 15, wherein at least one of said stationary inductor and said rotary inductor is discontinuous in the direction of rotation.

18. The charging device according to claim 17, wherein at least one of said stationary inductor and said rotary inductor has a geometry that is rotationally symmetrical with respect to the axis of rotation of said rotatable structure and wherein said stationary inductor and said rotary inductor are configured such that the total coupling surface for magnetic coupling between said stationary inductor and said rotary inductor is constant during rotation of said rotatable structure.

19. The charging device according to claim 15, wherein said distribution chute is supported by said rotatable structure so as to be pivotable about a substantially horizontal axis and wherein said electric load comprises an electric motor operatively associated to said distribution chute for varying the pivoting angle of said distribution chute.

20. The charging device according to claim 19, wherein said rotatable structure further comprises a forced-circulation cooling circuit and wherein said electric load further comprises at least one pump arranged on said rotatable structure.

* * * * *